US012546106B2

(12) United States Patent
Evans et al.

(10) Patent No.: US 12,546,106 B2
(45) **Date of Patent: *Feb. 10, 2026**

(54) DRYWALL HANGER

(71) Applicant: Simpson Strong-Tie Company, Inc., Pleasanton, CA (US)

(72) Inventors: Thomas G. Evans, Dublin, CA (US); Paul Bernard McEntee, Fremont, CA (US); James M. Benton, Tracy, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/464,609

(22) Filed: Sep. 1, 2021

(65) Prior Publication Data

US 2021/0396000 A1 Dec. 23, 2021

Related U.S. Application Data

(63) Continuation of application No. 16/001,821, filed on Jun. 6, 2018, now Pat. No. 11,142,902.

(60) Provisional application No. 62/516,637, filed on Jun. 7, 2017.

(51) Int. Cl.

| | |
|---|---|
| ***E04B 1/26*** | (2006.01) |
| ***E04B 1/58*** | (2006.01) |
| *E04B 5/12* | (2006.01) |

(52) U.S. Cl.

CPC ..... *E04B 1/2612* (2013.01); *E04B 1/5818* (2013.01); *E04B 1/2608* (2013.01); *E04B 5/12* (2013.01)

(58) Field of Classification Search

CPC .... E04B 1/2608; E04B 1/2612; E04B 1/5818; E04B 5/12

USPC ..... 52/289, 699, 702, 712, 715; 403/232.1

See application file for complete search history.

(56) References Cited

U.S. PATENT DOCUMENTS

| | | | |
|---|---|---|---|
| 537,505 | A | 4/1895 | Van Dorn |
| 1,097,934 | A | 5/1914 | Price |
| 1,300,132 | A | 4/1919 | Dessauer |
| 1,692,351 | A | 11/1928 | Ropp |
| 1,728,981 | A | 9/1929 | Ropp |
| 1,792,815 | A | 2/1931 | Chapin |

(Continued)

FOREIGN PATENT DOCUMENTS

| | | |
|---|---|---|
| EP | 1 672 133 | 6/2006 |
| ES | 2 224 819 | 10/2002 |

(Continued)

OTHER PUBLICATIONS

Simpson Strong-Tie, "Wood Construction Connectors: 2013-2014", pp. front cover, 69, 78, 83, 86, 89, 91, 100, 108, 110, 118, 134, 162, back cover, C-2013, Simpson Strong-Tie Company, Inc., Pleasanton, California, USA.

(Continued)

*Primary Examiner* — Brian E Glessner
*Assistant Examiner* — James J Buckle, Jr.
(74) *Attorney, Agent, or Firm* — Charles R. Cypher

(57) ABSTRACT

A connection utilizing a joist hanger to hang a joist or beam from a wood structural support member such as a top plate or header in cooperation with a first plurality of fasteners such as screws and one or more substantially vertical fire-resistant panels such as drywall.

8 Claims, 11 Drawing Sheets

(56) References Cited

U.S. PATENT DOCUMENTS 2,461,145 A 2/1949 Carl
2,495,408 A 1/1950 Christoffersen
2,717,801 A 9/1955 Neil
2,815,546 A 12/1957 Kenk
2,911,690 A 11/1959 Carol
3,125,785 A 3/1964 Conville
3,337,946 A 8/1967 Anderson et al.
3,420,560 A 1/1969 Pfahning
3,601,428 A 8/1971 Gilb
3,633,950 A 1/1972 Gilb
3,752,512 A 8/1973 Gilb
3,907,445 A 9/1975 Wendt
3,945,741 A 3/1976 Wendt
3,989,398 A 11/1976 Wendt
4,005,942 A 2/1977 Gilb
4,038,796 A 8/1977 Eckel
4,077,176 A 3/1978 Bauer
4,158,940 A 6/1979 Lancelot et al.
4,196,556 A 4/1980 Russo
4,230,416 A 10/1980 Gilb
4,261,155 A 4/1981 Gilb
4,283,892 A 8/1981 Brown
4,330,971 A 5/1982 Auberger
4,353,664 A 10/1982 Gilb
4,411,548 A 10/1983 Tschan
4,422,792 A 12/1983 Gilb
4,423,977 A 1/1984 Gilb
4,455,805 A 6/1984 Rionda et al.
4,480,941 A 11/1984 Gilb
4,498,801 A 2/1985 Gilb
4,527,375 A 7/1985 Braginetz
4,555,887 A 12/1985 Rionda et al.
4,561,230 A 12/1985 Rionda et al.
4,764,069 A 8/1988 Reinwall
4,841,690 A 6/1989 Commins
4,893,961 A 1/1990 O'Sullivan et al.
4,920,725 A 5/1990 Gore
4,949,929 A 8/1990 Kesselman et al.
4,957,186 A 9/1990 Reetz
4,982,548 A 1/1991 Abbey
5,042,217 A 8/1991 Bugbee
5,054,755 A 10/1991 Hawkes
5,058,358 A 10/1991 Stratton
5,071,280 A * 12/1991 Turner ..... F16B 9/058 403/283
5,104,252 A 4/1992 Colonias et al.
5,111,632 A * 5/1992 Turner ..... E04B 1/2612 52/703
5,201,156 A 4/1993 Newman
5,228,261 A 7/1993 Watkins
5,240,342 A * 8/1993 Kresa, Jr. ..... F16B 9/058 403/403
5,394,668 A 3/1995 Lim
5,437,137 A 8/1995 Allen
5,551,135 A 9/1996 Powers, III
5,555,694 A 9/1996 Commins
5,564,248 A * 10/1996 Callies ..... F16B 9/052 52/715
5,598,680 A 2/1997 Wilhelmi
5,603,580 A * 2/1997 Leek ..... F16B 9/058 52/702
5,625,995 A 5/1997 Martin
5,657,596 A 8/1997 Powers, III
5,692,864 A 12/1997 Powell et al.
5,740,643 A 4/1998 Huntley
5,755,070 A 5/1998 Hohmann
5,778,625 A * 7/1998 Druffel ..... H02G 3/20 52/576
5,829,216 A 11/1998 Newcomb et al.
5,836,131 A 11/1998 Viola et al.
6,079,176 A * 6/2000 Westra ..... E04G 9/10 52/700
6,123,745 A * 9/2000 Hess, III ..... E02D 27/013 52/700
6,131,358 A 10/2000 Wise
6,254,306 B1 7/2001 Williams
6,295,773 B1 10/2001 Alty
6,397,552 B1 6/2002 Bourque
6,427,391 B1 8/2002 Lyons
6,463,711 B1 10/2002 Callies
6,523,321 B1 2/2003 Leek et al.
6,662,511 B1 12/2003 Alty
6,817,157 B2 11/2004 Bourque
6,945,004 B1 9/2005 Ghiringhelli
7,254,926 B2 8/2007 Eldeen
7,334,372 B2 2/2008 Evans et al.
7,343,712 B2 * 3/2008 Shelton ..... E04G 23/0218 52/289
7,448,178 B2 11/2008 Visone
7,461,494 B2 12/2008 Frezza
7,971,409 B2 7/2011 Bak et al.
8,051,620 B2 11/2011 Kittlitz et al.
8,250,827 B2 8/2012 Lin et al.
8,322,096 B2 12/2012 Visser
8,387,333 B2 3/2013 Brekke
9,115,489 B2 8/2015 Bourdon
9,151,058 B1 10/2015 Leathe
9,206,594 B1 * 12/2015 Grevious ..... F16B 7/0486
9,228,338 B2 1/2016 Lin
9,394,680 B2 7/2016 Bundy et al.
10,024,049 B2 7/2018 Brekke et al.
10,260,232 B1 4/2019 Conboy
10,358,812 B2 7/2019 Jensen et al.
10,653,904 B2 5/2020 Conboy
10,814,150 B2 10/2020 Conboy
10,899,038 B2 1/2021 Conboy
2004/0244328 A1 * 12/2004 Bak ..... E04B 1/2612 52/715
2005/0155307 A1 7/2005 Timony
2006/0130414 A1 6/2006 Walther
2006/0191233 A1 * 8/2006 Tamlyn ..... E04B 1/2612 52/702
2007/0294979 A1 * 12/2007 Lin ..... E04B 1/2612 52/702
2008/0101855 A1 * 5/2008 Lin ..... F16B 9/058 403/232.1
2008/0163568 A1 7/2008 Shelton
2008/0237421 A1 10/2008 Szpotowski
2009/0113839 A1 * 5/2009 Carr ..... E04B 1/2612 52/712
2010/0043341 A1 2/2010 Staley
2012/0137612 A1 6/2012 Buckholt
2012/0222382 A1 * 9/2012 Brekke ..... E04B 1/2612 52/702
2012/0297724 A1 * 11/2012 Pope ..... E04B 1/2612 52/702
2013/0067850 A1 3/2013 Sasanecki
2014/0338282 A1 11/2014 Sidhu
2015/0167291 A1 * 6/2015 Bundy ..... E04B 1/2612 52/702
2015/0184370 A1 * 7/2015 Brekke ..... E04B 1/2612 52/708
2018/0038094 A1 * 2/2018 Brekke ..... E04B 1/2612
2018/0363289 A1 12/2018 Jensen et al.

FOREIGN PATENT DOCUMENTS

FR 2 609 742 7/1988
GB 185694 9/1922
GB 574457 1/1946
GB 678979 9/1952
GB 726794 3/1955
GB 1362564 8/1974
GB 2433522 6/2007
GB 2 451 853 2/2009
GB 2 452 492 3/2009
GB 2 472 692 2/2011
JP 3 14482 3/1991
JP 3206225 9/1991
JP 5-19406 3/1993
JP 2515383 10/1996
JP 2537712 6/1997

(56) References Cited

FOREIGN PATENT DOCUMENTS

| | | | |
|---|---|---|---|
| JP | 10088668 | | 4/1998 |
| JP | 10-159182 | | 6/1998 |
| JP | 11-62253 | | 3/1999 |
| JP | 2941921 | | 6/1999 |
| JP | 2000-96739 | | 4/2000 |
| JP | 3964051 | B2 | 8/2007 |
| WO | WO 2007/070924 | A1 | 6/2007 |
| WO | WO 2011/033289 | A1 | 3/2011 |

OTHER PUBLICATIONS

Patent Cooperation Treaty (PCT), The International Search Report and The Written Opinion of the International Searching Authority, or the Declaration: PCT/US2014/070142, Apr. 15, 2015, 11 pages, International Searching Authority, European Patent Office, Rijswijk, The Netherlands.

Stormer, Russell D., Office Action in US Reissue U.S. Appl. No. 16/040,467, filed Aug. 15, 2019, 8 pages, US Patent and Trademark Office, Alexandria, Virginia, USA.

Simpson Strong-Tie Company Inc., Technical Bulletin: Top-Flange Joist Hangers Installed on Walls over Wood Structural Panel Sheathing or Drywall, Aug. 1, 2013, 2 pages, T-C-TFWALL13, Simpson Strong-Tie Company Inc., Pleasanton, USA.

Simpson Strong-Tie Company Inc., Cold-Formed Steel Connectors for Residential and Mid-Rise Construction, Jan. 2010, 3 pages, C-CFS10, Simpson Strong-Tie Company Inc., Pleasanton, USA.

* cited by examiner

DRYWALL HANGER

FIELD OF INVENTION

The present invention relates to building construction and, more particularly, to a joist hanger adapted to secure a joist to a header or other structural support member with one or more drywall panels disposed between the end of the joist and the front surface of the structural support member.

BACKGROUND

Joist hangers are used in building construction to secure the ends of joists or other members to headers or other support members. Typically, the joist hanger includes a u-shaped portion that receives the joist. The bottom surface of the joist rests on the seat of the hanger, and the side walls of the hanger are dimensioned to closely receive the side faces of the joist, providing it with lateral support.

Where appropriate, the joist may be connected to the hanger by means of nails driven through the side walls into the side faces of the joist. These nails may simply be driven horizontally into the joist, in which case they are preferably short nails that will not pass through the joist. Alternatively, longer nails may be used that are driven horizontally and angularly into the joist such that they are driven into the header as well. This has been referred to as double-shear nailing. The other common way to nail the hanger to the joist is to use short nails that are driven downward at an angle into the joist only.

Often, in order to connect the joist hanger to the header, back flanges are attached to the side walls. Generally, these flanges extend laterally from the side walls, to overlap a portion of the face of the header. These flanges can extend inwardly or outwardly from the side walls, depending on design considerations.

Openings may be provided in the back flanges to receive fasteners. These fasteners are generally nails in light-frame wood construction. Screws and bolts are also used in wood construction, depending on the size of the members to be joined and other considerations. In light-gauge steel construction, sheet metal screws, bolts and rivets are commonly used.

In perhaps the simplest hangers, the back flanges extend outwardly from the side flanges, providing an easily-accessed fastening face. Fasteners are then driven though the back flanges into the header. In other instances, design considerations dictate which particular attachment method is used for attaching the joist and the hanger to the header.

In addition, top flanges may be attached to the back flanges to aid in attaching the hanger to the header. Hangers with top flanges are generally referred to as top-flange hangers. Hangers without top flanges are generally referred to as face-mount hangers. If the top flanges wrap over the top of the header and down the back of the header, the hanger can be called a wrap-around hanger. Again, various design considerations dictate what features are present in a hanger, and various building considerations dictate which hanger, or type of hanger, is used in a particular situation. Generally, if a top flange is used and the header is made of wood, pre-formed holes with be provided in the top flanges to receive suitable fasteners for connecting the top flange to the hanger. No such fastener openings are required in steel construction because the hanger is typically fastened to the header with self-drilling sheet metal screws or by welding.

As mentioned above, it is often desirable to fasten the joist to the hanger. This is generally done to resist uplift forces acting on the joist. Such forces are often caused by lateral loading on the building due to high winds or seismic activity. Also, one end of a joist must be downwardly restrained if that joist is cantilevered (e.g., to support an overhanging deck). As mentioned above, openings may be provided in the side walls of the hanger so that the joist can be held down with fasteners driven through the openings and into the joist.

Drywall is used in fire barriers, but it can be difficult to shield supporting structural members like top plates and headers at the connection between the supporting wall and a supported joist, because drywall is susceptible to cracking and crushing and has little bearing strength with regard to fasteners in the drywall. The present invention allows drywall to be easily applied to the supporting structural members, providing some shielding for them from fire and heat, and provides a joist hanger connection that does not damage the effectiveness of the drywall as a fire barrier. Importantly, the present invention does not require additional components. The drywall can simply be notched where the projecting side walls of the hanger will pass through the drywall, and then the drywall is inserted between the end of the joist and the wall.

The present invention uses sufficiently strong material for the side walls and the back flanges of the hanger such that they can hold the hanger away from the header and against the one or more drywall panels disposed between the joist and the support member without sagging. The hanger bears the load of the joist without crushing the drywall either during installation or use.

SUMMARY OF THE INVENTION

The present invention provides a connection that allows a joist hanger to be attached to a supporting structural member with fire-resisting panels interposed between the end of the joist and the supporting structural member without diminishing the effectiveness of the drywall panels to resist damage from fire or compromising the strength of the connection.

The present invention provides a connection in which a joist hanger is fastened to a structural member with drywall panels that have little or no dowel bearing strength being interposed between the end of the joist and the surface of the structural member with the drywall panels, the end of the joist and the hanger sufficiently covering the surface of the structural member such that the structural member is protected from fire to the same extent as it would be if the structural member was just covered by the same number of undisturbed drywall panels.

The present invention provides a connection in which a joist hanger is held away from the supporting structural member to which it is attached.

The present invention provides a joist hanger that has side walls or side members that extend through the drywall panels interposed between the portion of the joist hanger that receives the joist and the supporting structural member.

The present invention allows drywall panels to be placed over a supporting structural member thereby providing some shielding from the deleterious effects of fire and heat, with substantial portions of the top edges of the drywall panels reaching at least as high as the top of the structural support member.

The present invention provides a connection in which the joist hanger is connected to the supporting structural member by cantilevered side walls that extend through the one or more drywall panels.

The present invention provides a joist hanger that can be fastened to a structural support member with substantially non-load-bearing drywall panels being interposed between the end of the joist and the structural support member.

The present invention provides a hanger with back flanges that hold the joist away from the drywall panels.

The present invention provides a hanger with side members having offset upper and lower portions of the back edges of the side members.

DESCRIPTION OF THE PREFERRED EMBODIMENT

Figure 1:
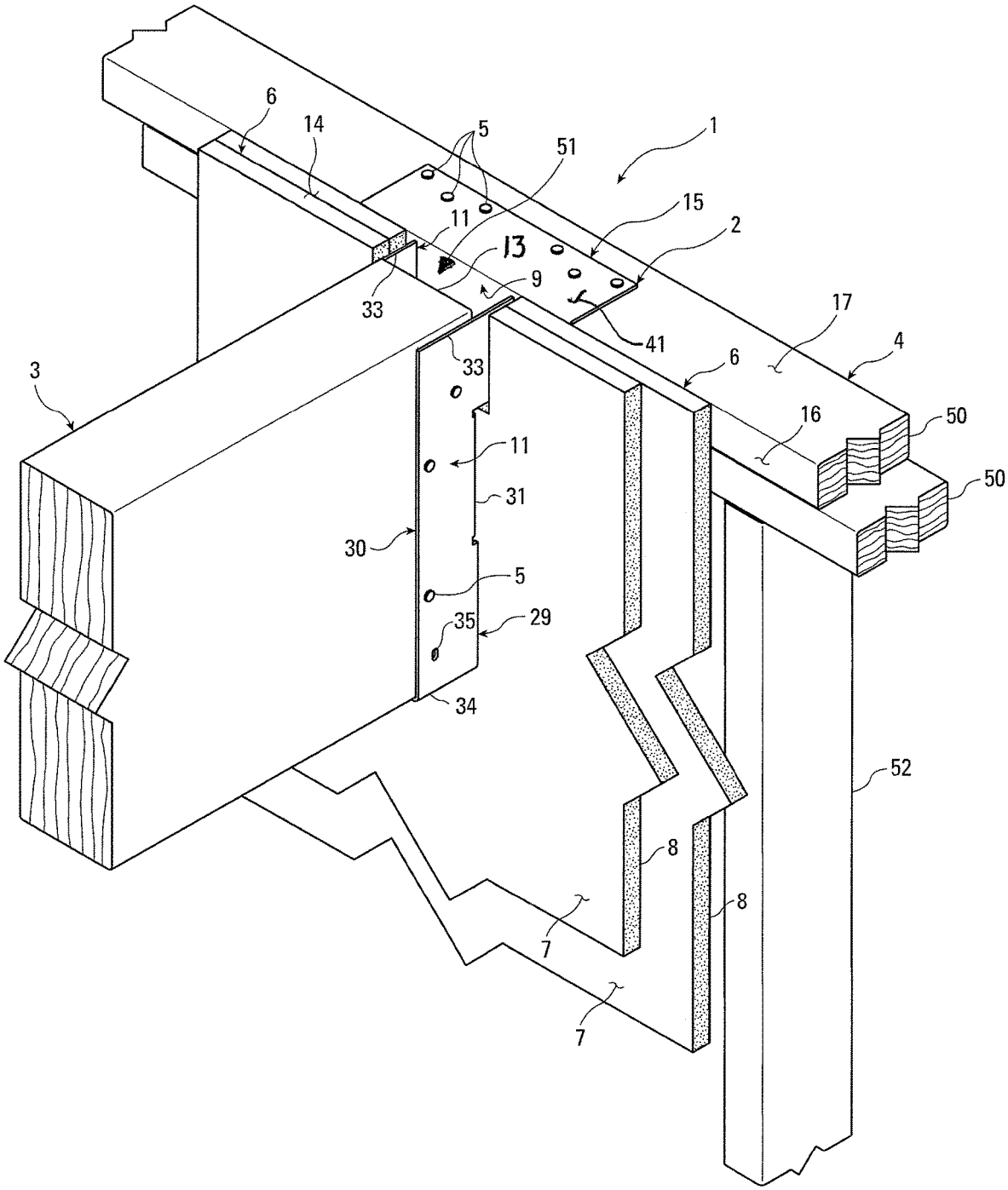
FIG. 1 is an upper right perspective view of a connection formed according to the present invention.

As shown in FIG. 1, the invention is a connection 1 utilizing a joist hanger 2 to hang a joist 3 from a structural support member 4 in cooperation with a one or more fasteners 5 and one or more substantially vertical drywall panels 6.

Preferably, the one or more drywall panels 6 shield the structural support member 4, and each of the one or more fire-resistant panels 6 has a front face 7, a back face 8 opposite the front face 7, and negligible dowel bearing strength. In order to show the vertically disposed studs and top plate 4 that makes up the wall the panels 6 are not shown as covering these members completely; however, preferably the panels 6 cover all of the structural members that make up the wall to a substantial degree to help protect them from fire.

Preferably, the structural support member 4 has a substantially vertical front face 16 and significant dowel bearing strength. The joist hanger 2 preferably supports the joist 3. The joist 3 has an end face 13 spaced away from the front face 16 of the structural support member 4.

Preferably, the joist hanger 2 has one or more back plate members 9. In FIGS. 1-6, the joist hanger 2 is shown with a single back plate member 9. In the embodiment shown in FIGS. 7-11, the joist hanger 2 has a second back plate member 9. The joist hanger 2 has a first side wall or side member 11, and a second side wall or side member 11.

The first back plate member 9 preferably has a first back face 10 in parallel registration with the front face 16 of the structural support member 4. Preferably, the second back plate member 9, if present, also has a second back face 10 in parallel registration with the front face 16 of the structural support member 4. The first side member 11 preferably is connected to the first back plate member 9. Preferably, the second side member 11 is connected to the first back plate member 9 or the second back plate member 9, if present.

Figure 2:
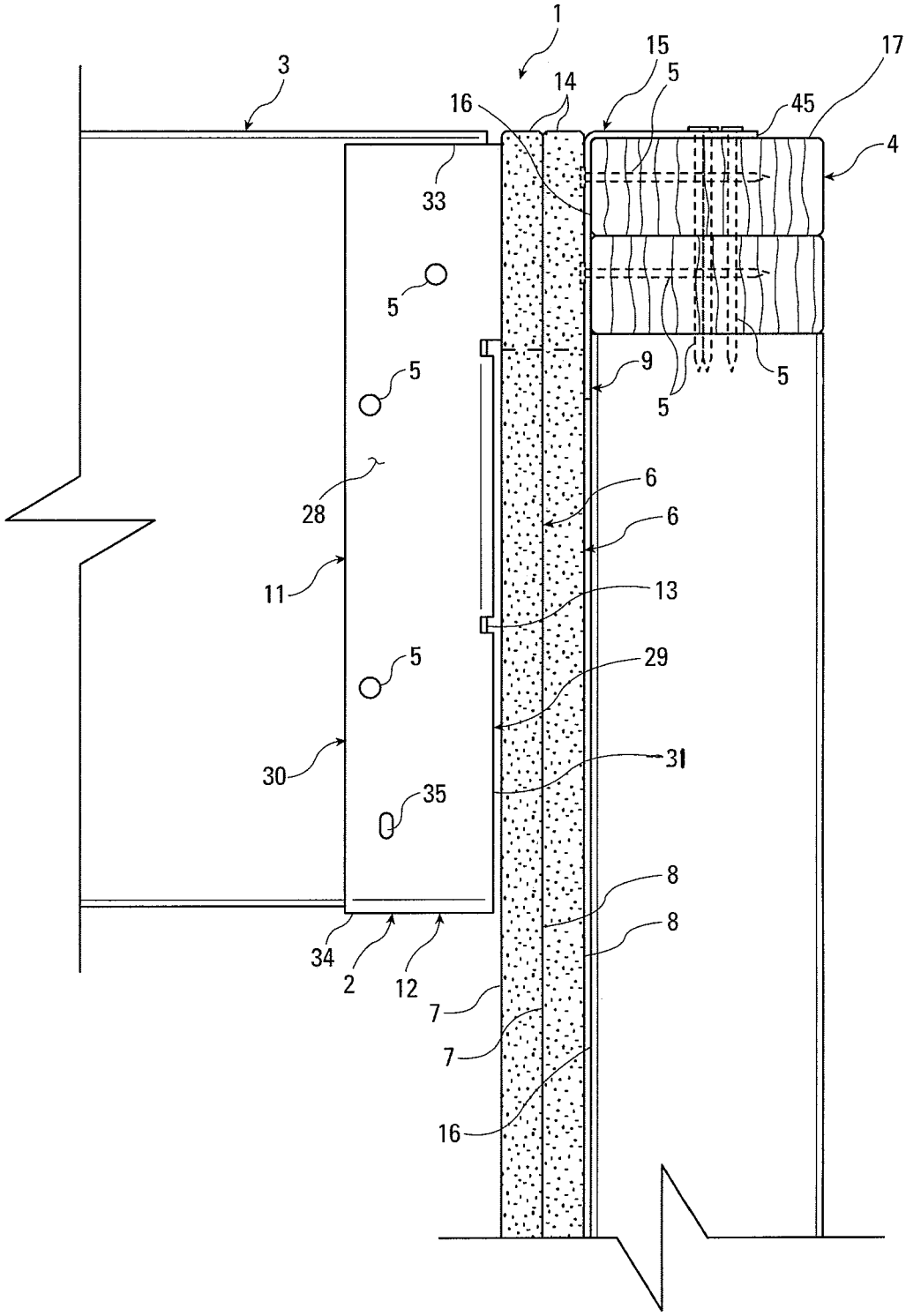
FIG. 2 is a cross-sectional right side elevation view of the connection shown in FIG. 1.

As shown in FIG. 2, at least one of the first plurality of fasteners 5 preferably passes through the first back plate member 9 and into the structural support member 4. Preferably, at least one of the first plurality of fasteners 5 passes through the second back plate member 9, if present, and into the structural support member 4. The joist 3 preferably is supported by the joist hanger 2. Preferably, the one or more panels 6 are between the joist 3 and the structural support member 4 and the back face 8 of one panel 6 of the one or more panels 6 interfaces with the front face 16 of the structural support member 4.

The one or more back plate members 9 preferably are planar, with front faces 19 opposite the back faces 10. In the embodiment shown in FIGS. 7-11 with first and second back plate members 9, each has first and second inner edges 20 that preferably are linear, and first and second outer edges 21 opposite the first and second inner edges 20. The one or more back plate members 9 preferably have one or more top edges 24 that are oriented upwardly and first and second bottom edges 25 that are oriented downwardly. The one or more back plate members 9 preferably are formed with fastener openings 26. Although the back plate members 9 are shown as splayed outwardly in opposite directions in FIGS. 7-11, they could both be bent inwardly to face each other between the first and second side members 11, or they could both be bent in the same direction, either left or right, with one between the first and second side members 11.

The joist hanger 2 of the present invention is preferably formed from light gauge sheet steel.

The first and second side members 11 preferably are planar as well, with first and second inner faces 27 that face the joist 3, and first and second outer faces 28 opposite the first and second inner faces 27.

Figure 7:
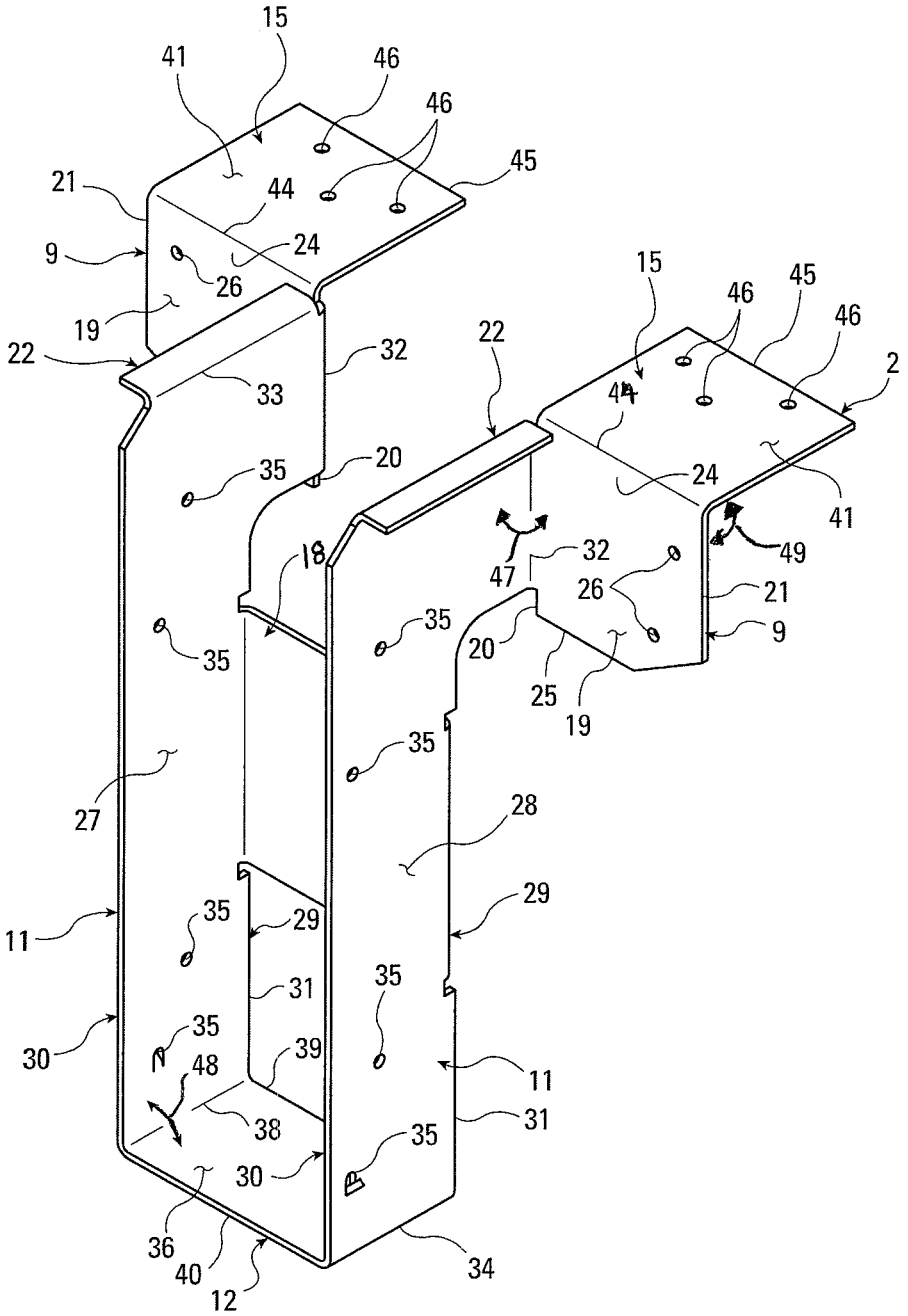
FIG. 7 is an upper right perspective view of an alternate joist hanger that can be used to make the connection shown in FIG. 1.
Figure 8:
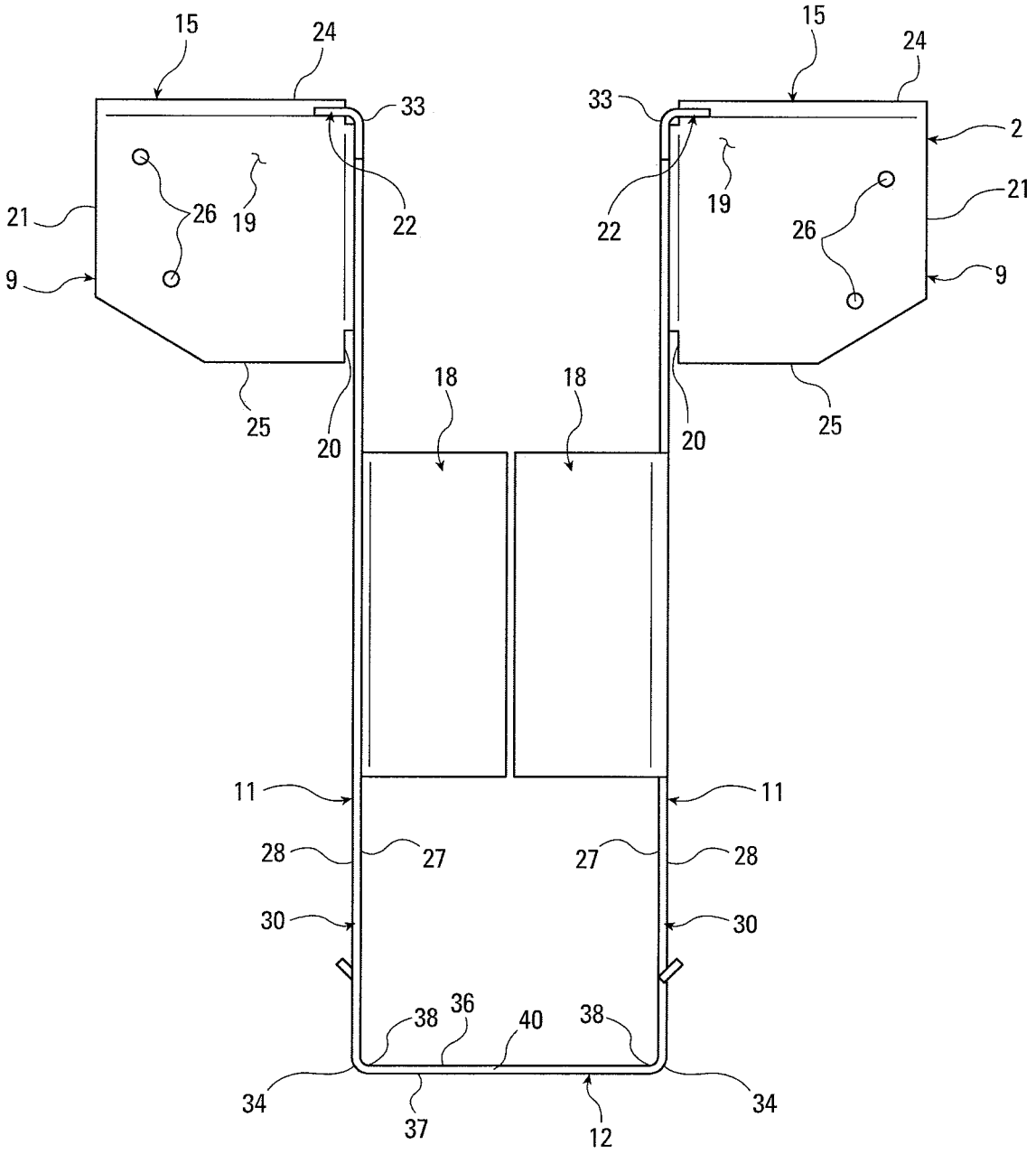
FIG. 8 is a front elevation view of the joist hanger shown in FIG. 7.
Figure 9:
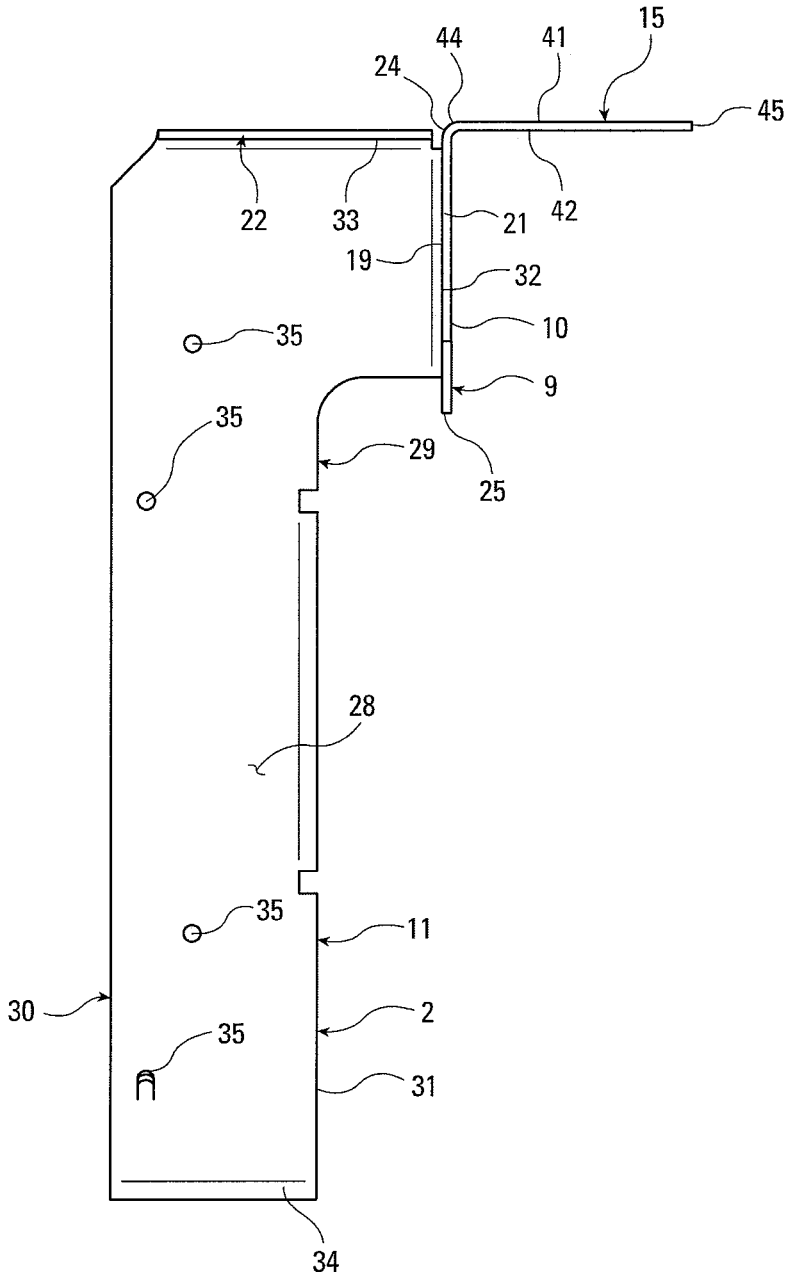
FIG. 9 is a right side elevation view of the joist hanger shown in FIG. 7.
Figure 10:
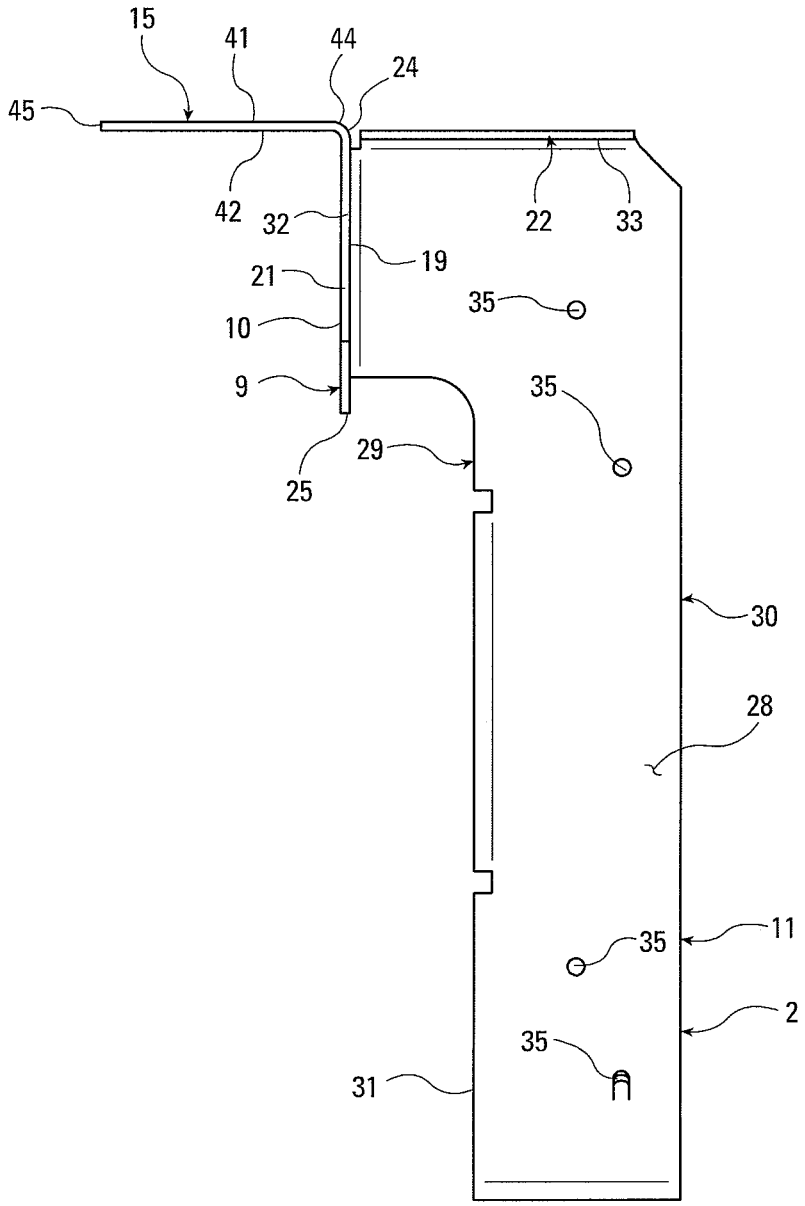
FIG. 10 is a left side elevation view of the joist hanger shown in FIG. 4.
Figure 11:
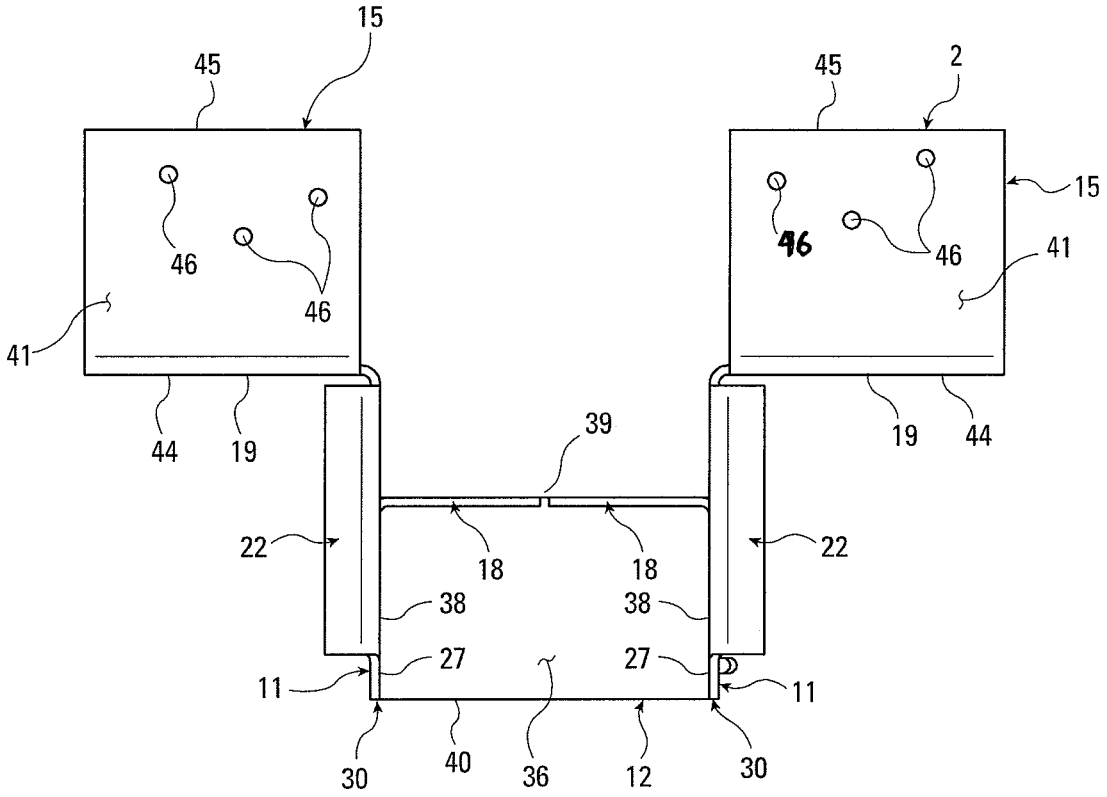
FIG. 11 is a top plan view of the joist hanger shown in FIG. 4.

As shown in FIG. 7, the first and second side members 11 preferably have first and second back edges 29 that form an angular joint 47, preferably an orthogonal joint, where they meet the first and second inner edges 20 of the first and second back plate members 9. As shown in FIG. 1, the first and second back edges 29 of the first and second side members 11 form an angular joint 47 with the back plate member 9.

The first and second side members 11 preferably have first and second front edges 30 opposite the first and second back edges 29.

Figure 3:
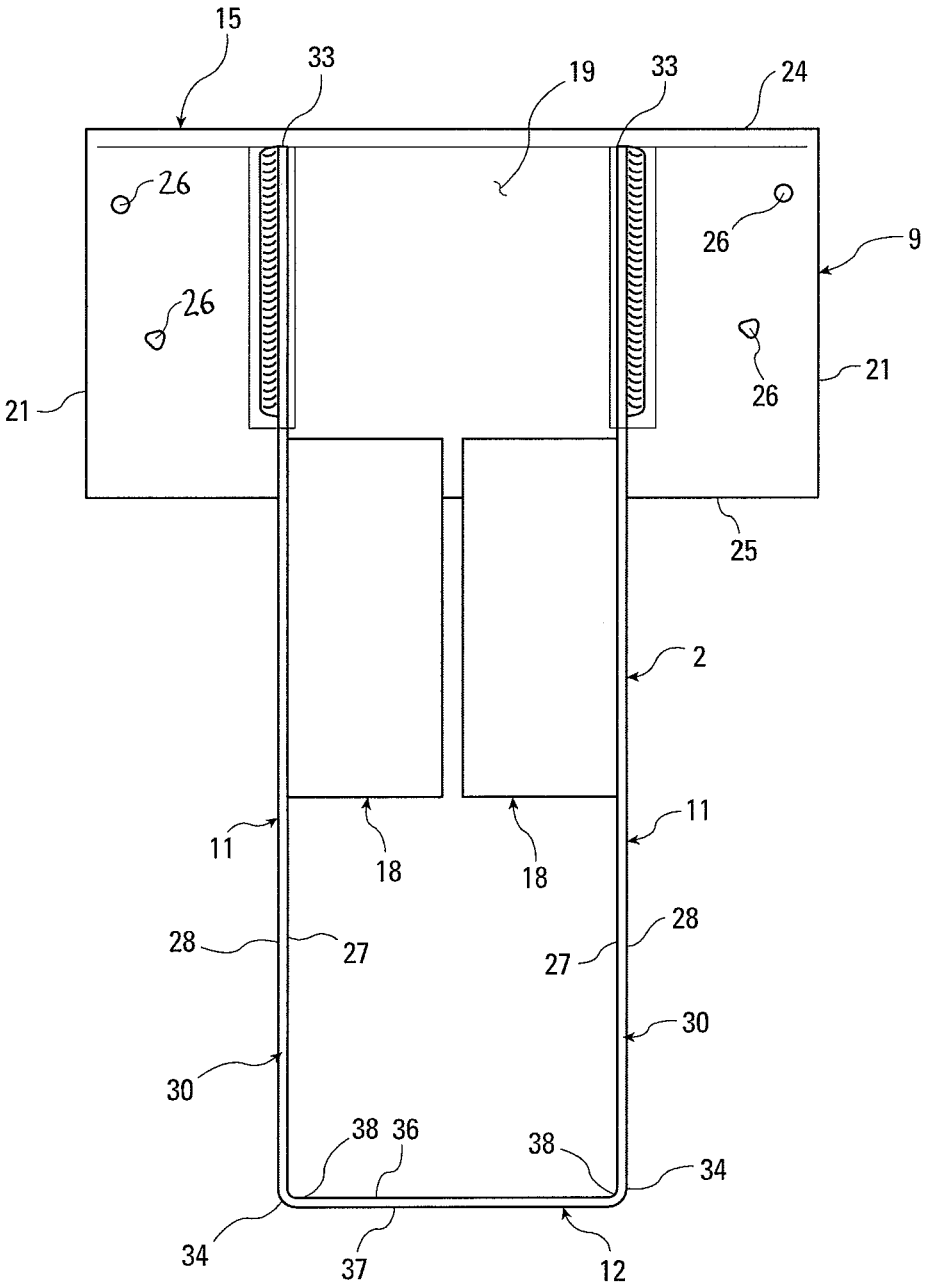
FIG. 3 is a front elevation view of the joist hanger shown in FIG. 1.
Figure 4:
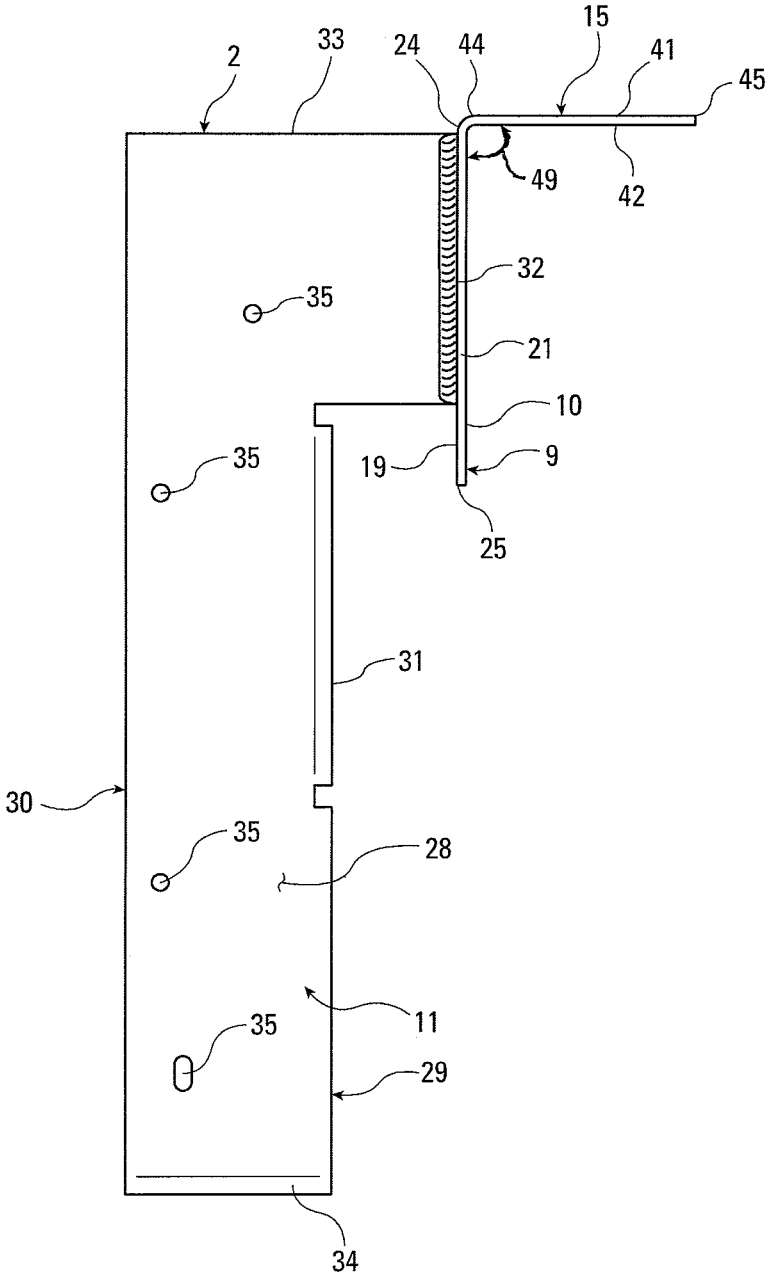
FIG. 4 is a right side elevation view of the joist hanger shown in FIG. 1.
Figure 5:
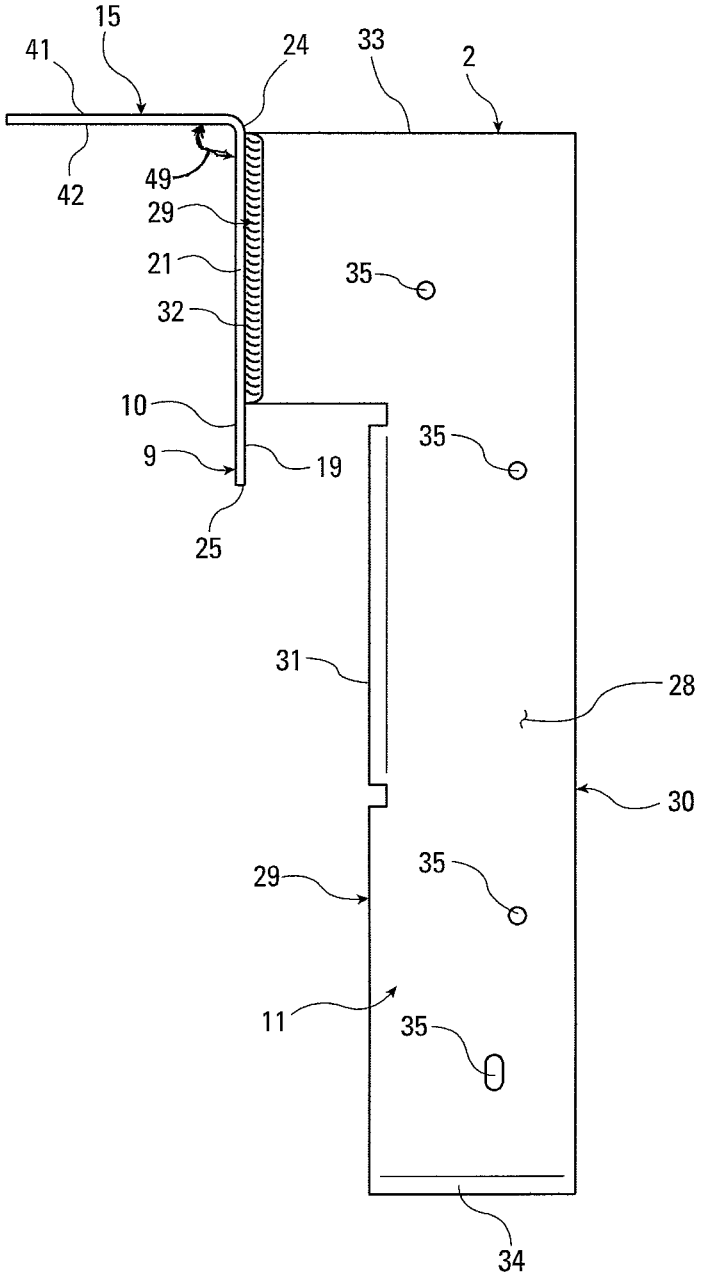
FIG. 5 is a left side elevation view of the joist hanger shown in FIG. 1.
Figure 6:
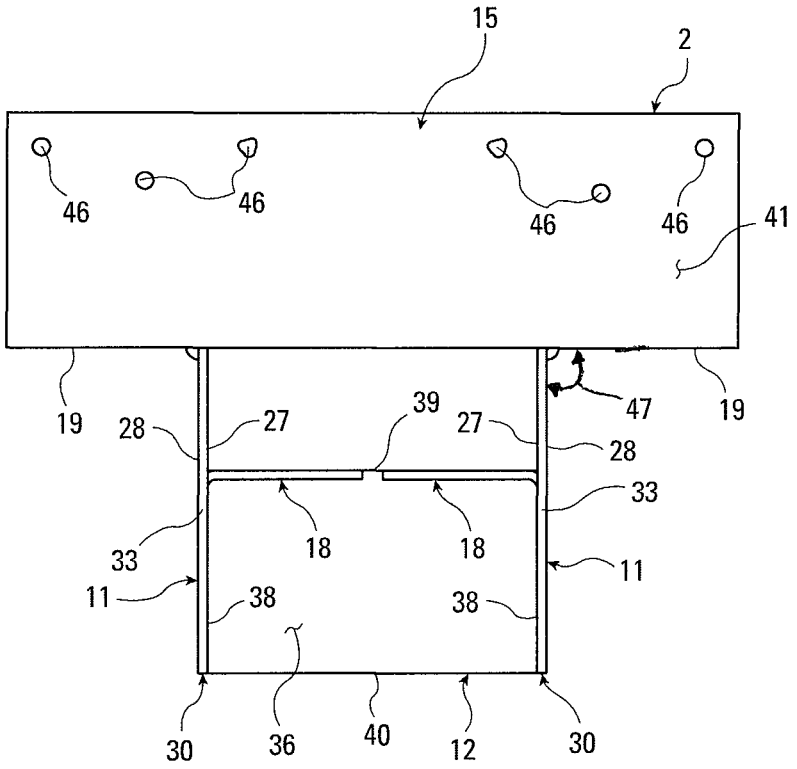
FIG. 6 is a top plan view of the joist hanger shown in FIG. 1.

The first and second back edges 29 preferably have lower portions 31 and upper portions 32 with the first and second lower portions 31 being offset from the first and second upper portions 32. This creates space between the lower portion of the first and second side members 11 where the drywall panels 6 can be inserted behind the end of the joist 3 without having to notch or disturb these portions of the drywall panels 6. The side members 11 are generally L-shaped members with the upper portions extending through the drywall panels 6. As shown in FIGS. 3 and 7 back flanges 18 can be attached to the first and second lower portions 31 of the first and second back edges 29. The back flanges hold the end or end surface 13 of the joist away from the front surface 7 of the drywall panel 6 closest to the end 13 of the joist 3.

The first and second side members 11 preferably have first and second top edges 33. As shown in FIG. 7, side top flanges 22 can be connected to the top edges 33 to strengthen the side members 11. The first and second side members 11 also preferably have first and second bottom edges 34 opposite the first and second top edges 33. The first and second side members 11 preferably are formed with fastener openings 35.

The one or more panels 6 preferably are drywall panels 6. Drywall, otherwise known as plasterboard, wallboard, gypsum board, sheetrock, or gyprock, is a panel made of gypsum plaster pressed between two thick sheets of paper. It is used to make interior walls and ceilings. In the United States and Canada, drywall panels are manufactured in 48-inch wide panels in varying lengths. Common panel thicknesses are ½-inch and ⅝-inch. In the present invention, two layers of ⅝-inch drywall is preferred. Drywall is naturally fire resistant and can be used to cover and protect the structural members of a building. However, gypsum is friable and has little or no dowel bearing strength. Other panel materials and qualities are also possible.

Preferably, the joist hanger has a seat member 12 interconnecting the first and second side members 11, and the joist 3 rests on the seat member 12 between the first and second side members 11.

Preferably, the back surface 8 of the rearmost drywall panel 6 and the upper portions 32 of the back edges 29 of the side members 11 contact or are in close proximity to the front face 16 of the structural support member 4. The side members 11 extend through the drywall panels 6. The joist hanger 2 is not embedded in the structural support member 4. The seat member 12 preferably has an upper face 36 that interfaces with the joist 3. The seat member 11 also preferably has a lower face 37 opposite the upper face 36, first and second linear side edges 38, a back edge 39 that can be orthogonal to the first and second side edges 38, and a front edge 40 that can be parallel to the back edge 39. The first and second side edges 38 preferably form an angular joint 48, where they meet the first and second bottom edges 34 of the first and second side members 11.

The joist hanger 2 has one or more top flanges 15 connected to the one or more back plate members 9. The one or more top flanges 15 preferably contact the top face 17 of the structural support member 4. Preferably, the one or more top flanges 15 are fastened to the structural support member 4. The structural support member 4 preferably has a top face 17, the first and second top flanges 15 are fastened to the top face 17 of the structural support member 4. Preferably, the first and second top flanges 15 are fastened to the structural support member 5 with one or more fasteners 5. As shown these fasteners 5 can be nails.

The one or more top flanges 15 preferably are planar, with upper faces 41 and bottom faces 42 opposite the upper faces 41. Preferably, the bottom faces 42 contact the top face 17 of the structural support member 4. The one or more top flanges 15 preferably have front edges 44 and back edges 45. The front edges 44 preferably form an angular joint 49, preferably orthogonally where they meet the one or more top edges 24 of the one or more back plate members 9. The first and second top flanges 15 can be formed with fastener openings 46.

Typically, the structural support member 4 is a top plate 4 which can consist of one or more parts 50. The parts 50 of the top plate 4 can be two pieces of 2×4 or 2×6 dimensional lumber 50. The structural support member 4 can include the studs 52 that support the structural support member 4 and make up the wall.

Preferably, each of the one or more panels 6 has a top edge face 14 and the structural support member 4 has a top face 17. In the preferred embodiment, only a small notch 51 is made in the one or more drywall panels 6 between the end 13 of the joist 3 and the structural support member 4 such that most of the top edge face 14 of each of the one or more panels 6 preferably is located at the level of the top face 17 of the structural support member or above the top face 17 of the structural support member 4, thereby helping to shield and protect the structural support member 4. Similarly, the drywall panels 6 are disposed between most of the end 13 of the joist 3 and the wall of which the structural support member 4 is a part.

As shown in FIG. 7, the first back plate member 9 preferably has a first top edge 24, a first bottom edge 25, a first substantially vertical inner edge 20, a first outer edge 21 opposed to the first substantially vertical inner edge 20, and a first back face 10 adapted to be in parallel registration with the front face 16 of the structural support 4. Preferably, the second back plate member 9 also has a second top edge 24, a second bottom edge 25, a second substantially vertical inner edge 20, a second outer edge 21 opposed to the second substantially vertical inner edge 20, and a second back face 10 in parallel registration with the front face 16 of the structural support member 4.

Substantially all of the one or more back faces 10 of the one or more back plate members 9 preferably interfaces with the front face 16 of the structural support 4. The joist hanger (3) of FIGS. 1-6 is preferably formed by forming the back plate member 9 and the top flange 15 as a single piece and the seat member (12) and side members 11 as a single piece and joining the two parts together by welding. The joist hanger (3) of FIGS. 7-11 is preferably formed as a single piece of sheet metal that is bent into its final shape.

We claim:

1. A connection (1) utilizing a joist hanger (2) to hang a joist (3) from a structural support member (4) in cooperation with a first plurality of fasteners (5) and one or more generally vertical drywall panels (6), the connection (1) comprising:

a. the one or more drywall panels (6) providing shielding to the structural support member (4), each having a front face (7), a back face (8) opposite the front face (7), the panels (6) being drywall panels such that they have negligible dowel bearing strength compared to the structural support member (4);

b. the one or more fasteners (5) connecting the joist hanger (2) to the structural support member (4);

c. the structural support member (4) having a generally vertical front face (16) and the structural support member (4) having significant dowel bearing strength compared to the one or more drywall panels (6);

d. the joist (3) supported by the joist hanger (2), the joist having an end face (13) spaced away from the front face (16) of the structural support member (4) and side faces; and e. the joist hanger (2) supporting the joist (3), the joist hanger (2) comprising:

i. one or more back plate members (9) having one or more back faces (10) in parallel registration with the front face (6) of the structural support member (4);

ii. a first side member (11) connected to the one or more back plate members (9); and iii. a second side member (11) connected to the one or more back plate members (9), wherein:

f. portions of the one or more panels (6) are disposed between the end face (13) of the joist (3) and the structural support member (4) and the back face (8) of one panel (6) of the one or more panels (6) interfaces with the front face (16) of the structural support member (4), and the one or more panels (6) are formed with a notch (51) where the first and second side members (11) pass through the one or more panels (6) and one back plate member (9) of the one or more back plate members (9) substantially covers the notch (51) with a bottom edge (25) of the one back plate member (9) of the one or more back plate members (9) disposed below a bottom edge of the notch (51), outer edges (21) of the one back plate member (9) of the one or more back plate members (9) disposed outwardly from sides face edges of the notch 51, and a top edge (24) of the one back plate member (9) or the one or more back plate members (9) extending to a top face (17) of the structural support member (4).

2. The connection (1) of claim 1 wherein:

the joist hanger has a seat member (12) interconnecting the first and second side members (11); wherein the joist (3) rests on the seat member (12) between the first and second side members (11).

3. The connection (1) of claim 1 wherein:

a. the joist hanger (2) has one or more top flanges (15) connected to the one or more back plate members (9);

b. the structural support member (4) has top face (17); and the one or more top flanges (15) are fastened to the top face (17) of the structural support member (4).

4. The connection (1) of claim 1 wherein:

a. each of the one or more panels (6) has a top edge face (14); and b. portions of the top edge face (14) of each of the one or more panels (6) is located at the level of the top face (17) of the structural support member or above the top face (17) of the structural support member.

5. The connection (1) of claim 1 wherein:

the first and second side members (11) have first and second top edges (33), and side top flanges (22) are connected to the top edges (33).

6. The connection (1) of claim 1 wherein:

one or more back flanges (18) are connected to at least one of the first or second side member (11), the one or more back flanges (18) interfacing with the end surface (13) of the joist (3).

7. The connection (1) of claim 1 wherein:

the first and second side members (11) have first and second back edges (29) with the first and second back edges (29) having first and second lower portions (31) and first and second upper portions (32) with the first and second lower portions (31) being offset from the first and second upper portions (32), with the first and second upper portions 32 contacting the one or more back plate members (9), and the first and second lower portions being spaced away from the front face (16) of the structural support member (4).

8. The connection (1) of claim 7, wherein:

one or more back flanges (18) are connected to at least one of the first or second side member (11) at the lower portions (31) of the first and second back edges (29).

* * * * *